US005124613A

United States Patent [19]

Park et al.

[11] Patent Number: 5,124,613

[45] Date of Patent: Jun. 23, 1992

[54] DEFLECTION YOKE

[75] Inventors: Wonseok Park, Suwon; Sungbae Chung, Jinhae; Jaeho Kang, Hwasung; Woongseon Choi, Kyunggi; Jongpil Jin, Younki; Sunhaeng Lee; Hyunseung Yang, both of Seoul; Hyunjeong Shin, Kyungii, all of Rep. of Korea

[73] Assignee: Samsung Electron Devices Co., Ltd., Kyunggi, Rep. of Korea

[21] Appl. No.: 632,145

[22] Filed: Dec. 21, 1990

[30] Foreign Application Priority Data

| | | | |
|---|---|---|---|
| Dec. 23, 1989 | [KR] | Rep. of Korea | 89-19752[] |
| Aug. 18, 1990 | [KR] | Rep. of Korea | 90-12443[U] |
| Aug. 18, 1990 | [KR] | Rep. of Korea | 90-12444[U] |
| Aug. 27, 1990 | [KR] | Rep. of Korea | 90-13067[U] |
| Sep. 19, 1990 | [KR] | Rep. of Korea | 90-14577[U] |
| Oct. 24, 1990 | [KR] | Rep. of Korea | 90-16292[U] |

[51] Int. Cl.[5] ..... H01J 29/70

[52] U.S. Cl. ..... 313/440; 313/413; 313/421; 313/431; 335/210; 335/212; 335/213

[58] Field of Search ..... 313/413, 431, 440, 421; 335/210, 211, 212, 213, 214

[56] References Cited

U.S. PATENT DOCUMENTS

| | | | |
|---|---|---|---|
| 4,853,588 | 8/1989 | Ohtsu | 313/440 |
| 4,882,521 | 11/1989 | Arimoto | 313/440 |
| 5,017,900 | 5/1991 | Ura et al. | 313/440 |

FOREIGN PATENT DOCUMENTS

| | | |
|---|---|---|
| 62-100935 | 5/1987 | Japan . |
| 62-223952 | 10/1987 | Japan . |
| 64-45046 | 2/1989 | Japan . |

*Primary Examiner*—Donald J. Yusko
*Assistant Examiner*—Nimeshkumar D. Patel
*Attorney, Agent, or Firm*—Christie, Parker & Hale

[57] ABSTRACT

A deflection yoke capable of damping the leaking magnetic fields leaking to the front of the screen is disclosed. The characteristic feature of the deflection yoke includes: two pairs of ferrite cores opposingly facingly disposed on the flange portion of the beam outgoing side of the deflection yoke; and coils extended from the horizontal deflection coil and wound on the ferrite cores in such a manner as to offset all the magnetic fields other than the main horizontal deflection magnetic field.

18 Claims, 13 Drawing Sheets

DEFLECTION YOKE

BACKGROUND OF THE INVENTION (1) Field of the Invention

The present invention relates to a deflection yoke, and particularly to a deflection yoke which is capable of damping the magnetic fields leaking to the front of the screen.

(2) Description of the Prior Art

Generally, a deflection yoke includes: a pair of semi-trumpet shaped pieces made of synthetic resin; a horizontal deflection coil disposed within the semi-trumpet shaped pieces for providing a horizontal deflection magnetic field for deflecting electron beams; and a vertical deflection coil disposed to the outside of the semi-trumpet shaped pieces to provide a vertical deflection magnetic field to the electron beams.

The deflection yoke constituted as described above is installed on the neck portion of cathode ray tube. If horizontal and vertical saw teeth-shaped wave currents are supplied to the deflection yoke, the horizontal and vertical coils form deflection magnetic fields, and these magnetic fields deflect the electron beams from an electron gun up and down and leftwardly and rightwardly, thereby distributing the electron beams to the raster of the screen.

However, of the coils for deflecting the electron beams, the horizontal coil produces superfluous magnetic fields to the front of the screen. Such leaking magnetic fields not only give adverse effects to the electric or electronic apparatuses disposed around the screen, but also inflict harmful effects to the human body.

Accordingly, coming recently, a stern standard is introduced against the leaking magnetic fields which are produced from the above described deflection yoke.

One conventional way of protecting against leaking magnetic fields is to cover the cathode ray tube and deflection yoke with a conical metal shield during installation in the picture display device. However, such a protecting shield is effective in shielding the picture displayer from external magnetic fields rather than keeping the magnetic fields of the deflection yoke from being leaked to the front of the screen.

Meanwhile, Japanese Patent Application Laying-opening No. Sho-62-100935 discloses a displaying tube which includes: a rear portion for accommodating at least one of an electron beam generating unit, and a front portion consisting of a phosphorescent screen, in order to inhibit the leaking magnetic fields without using the protecting shield. Further, there is provided an electron deflection unit consisting of a line deflection coil and a field deflection coil for producing a magnetic field having a dipole component if energized. This electron deflection unit is capable of deflecting the electron beams across the displaying screen, and is disposed at the periphery of the displaying tube. This displaying tube is provided with an inhibiting coil, and the posture of this inhibiting coil is adjusted in such a manner that at least a part of the dipole magnetic field detectable at a distance from the screen is kept to below the standard, thereby keeping a leaking magnetic field from being produced (Refer to FIGS. 1*a* and 1*b*).

This device is based on the understanding that, if a leaking magnetic field is to be inhibited at a distance of 3 m from the magnetic field source, the dipole component of the magnetic field has only to be compensated.

Therefore, this device provides a method of installing an inhibiting coil for inhibiting the dipole component of the magnetic field by means of a line deflection coil. That is, as shown in FIG. 1*a*, an impediment control coil 13 is installed above a picture displayer 11 and within a cabinet 12 which houses the picture displayer 11. Further, as shown in FIG. 1*b*, a pair of degaussing coils 15*a*, 15*b* are installed around the funnel portion of the tube.

However, this method has the problem of cost increase, and with regard to the damping of the impeding magneting field, no satisfactory result has been achieved.

Further, Japanese Patent Laying-opening No. Sho-64-45046 discloses a cathode ray tube in which a ferrite ring is installed between the screen and the deflection yoke in order to reduce the magnetic fields leaking to the front of the screen from the deflection yoke. According to this method, however, if the horizontal deflection frequency has a low frequency, a high permeability ferrite ring has to be used, while, if it is a high frequency, a low permeability ferrite ring has to be used, this being a problematic feature.

Further, Japanese Patent Laying-opening No. Sho-62-223592 discloses a method in which a current having a time function corresponding to the time function for the current supplied to the horizontal deflection coil (producing a stray magnetic field) is supplied to a stray magnetic field reducing current line, so that the magnetic field produced by the current line should be able to neutralize the stray magnetic field related to the stray magnetic field generation region. The stray magnetic field reducing current lines 22 according to the above described method as shown in FIGS. 2*a* to 2*d* are disposed on the upper and lower edges of the front face of a picture displayer face plate 21 in the horizontal form, and are also disposed on the left and right edges of it in the vertical form, while they are also connected to the deflection yoke in parallel or in series.

According to this method, however, it is a complicated process to install the current lines near the face plate of the cathode ray tube, and the manufacturing cost is increased, while its effect is not significant.

SUMMARY OF THE INVENTION

The present invention is intended to overcome the above described disadvantages of the conventional techniques.

Therefore it is the object of the present invention to provide a deflection yoke in which the magnetic fields leaking to the front of the screen of the cathode ray tube is effectively damped by means of a simple structure.

In achieving the above object, the deflection yoke according to the present invention (for deflecting electron beams from an electron gun in a state installed within the neck portion of a cathode ray tube) comprises: a pair of ferrite cores installed at proper positions on the flange portion of the beam outgoing side of the deflection yoke in an opposingly facing manner; and coils extended from the horizontal deflection coil of the deflection yoke, and wound on the ferrite cores so as for a magnetic field generating means to be formed, and so as for the magnetic field produced from the coils to neutralize the magnetic fields other than the main magnetic field of the horizontal deflection coil.

These coils can be connected in parallel or in series, and depending on the circumstance, current adjusting coils can be installed at the input and output terminals of the coils.

In the deflection yoke having the features as described above, the pairs of the ferrite cores may be desirably installed at an angle $\theta 1$ (refer to FIG. 5*a*) of 58–63 degrees relative to the axis of the deflection yoke. Meanwhile, the pairs of the ferrite cores may desirably be spread at an angle $\theta 2$ (refer to FIG. 5*b*) of 25–45 degrees from the centre of the deflection yoke.

In the deflection yoke described above, the winding directions of the upper and lower coils wound on the upper and lower ferrite cores should be desirably opposite from each other.

According to the first embodiment of the present invention, the ferrite cores accommodated within a ferrite core housing which is installed on the flange portion which is disposed at the beam outgoing side of the deflection yoke.

According to the second embodiment of the present invention, the ferrite core accommodating housing is installed on the flange portion at the beam outgoing side of the deflection yoke in a detachable form.

According to the third embodiment of the present invention, the ferrite cores are installed in such a manner that their angular postures should be adjustable, the adjustment being performed by means of a sector gear.

According to the fourth embodiment of the present invention, auxiliary steel pieces are attached at the open leading ends of the ferrite cores.

In the different embodiments of the present invention described above, the superfluous leaking magnetic fields produced from the deflection coils, and particularly from the horizontal deflection coil can be effectively neutralized.

BRIEF DESCRIPTION OF THE DRAWINGS

The above object and other advantages of the present invention will become more apparent by describing in detail the preferred embodiment of the present invention with reference to the attached drawings in which:

FIGS. 4*a* to 4*d* illustrate the connections of the coils according to the present invention in which:

FIGS. 4*a* and 4*b* illustrate the cases where no correcting coil is provided; and FIGS. 4*c* and 4*d* illustrate the cases where there are provided correcting coils;

DESCRIPTION OF THE PREFERRED EMBODIMENT

Figure 1A:
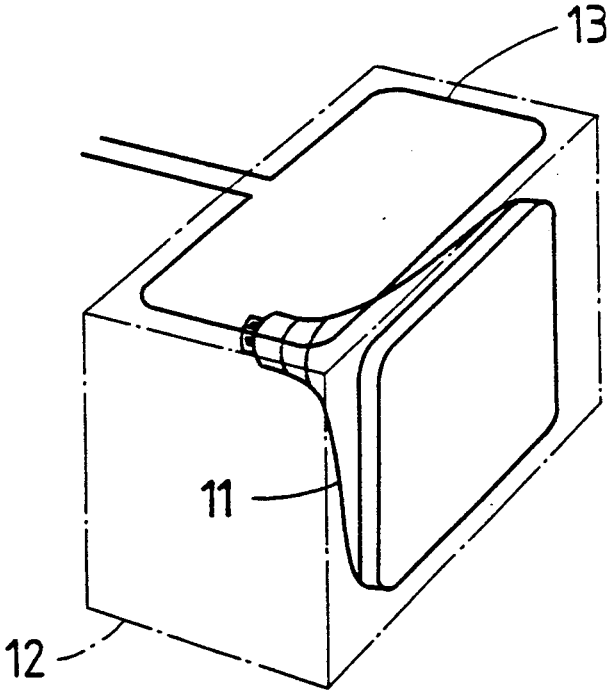
FIG. 1a Prior Art
FIG. 1*a* is a schematical perspective view of a conventional picture tube provided with an impediment control coil.
Figure 1B:
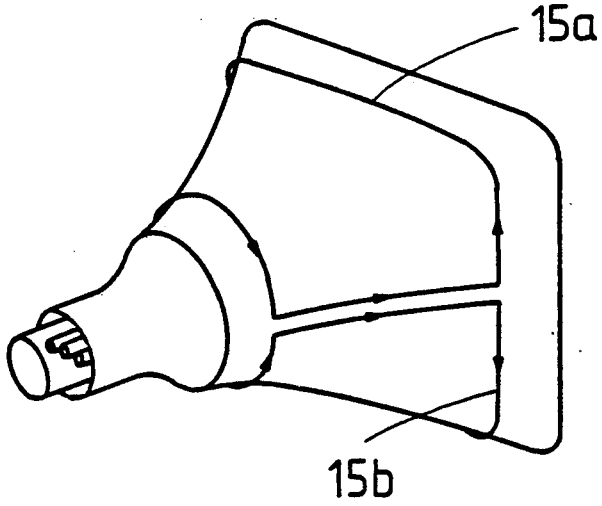
FIG. 1b Prior Art
FIG. 1*b* is a schematical perspective view of a conventional picture tube provided with two impediment control coils.
Figure 2A:
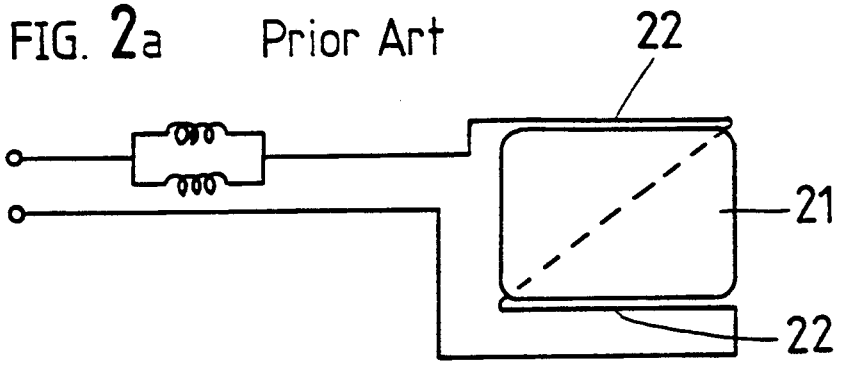
FIG. 2a Prior Art
FIGS. 2*a* to 2*d* illustrate the approximate installation locations of the conventional stray magnetic field reducing current lines for neutralizing the stray magnetic fields related to the stray magnetic field generation region.
Figure 2B:
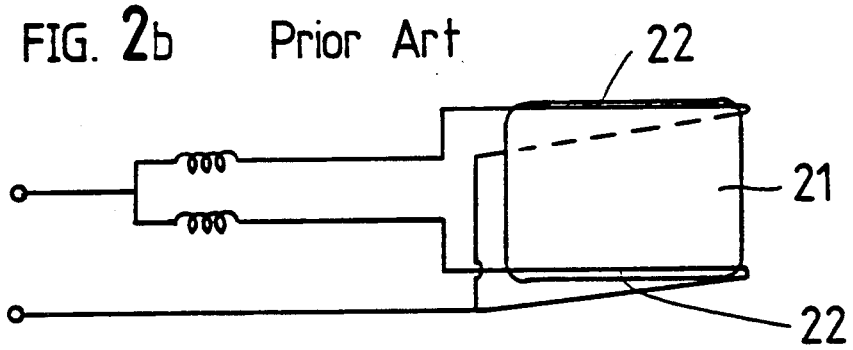
FIG. 2b Prior Art
Figure 2C:
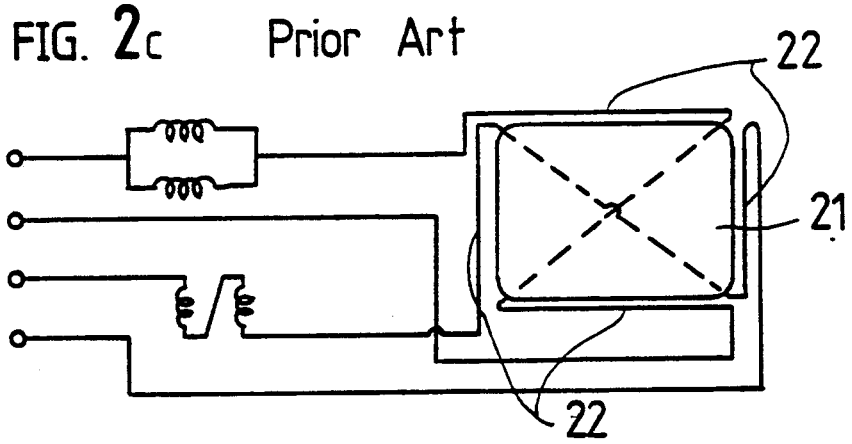
FIG. 2c Prior Art
Figure 2D:
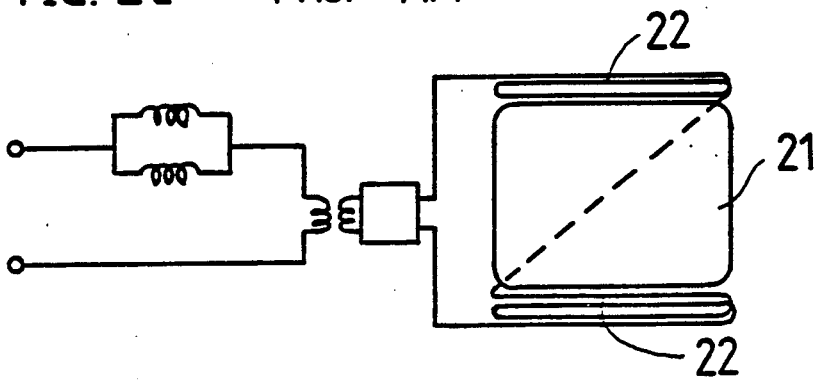
FIG. 2d Prior Art
Figure 3:
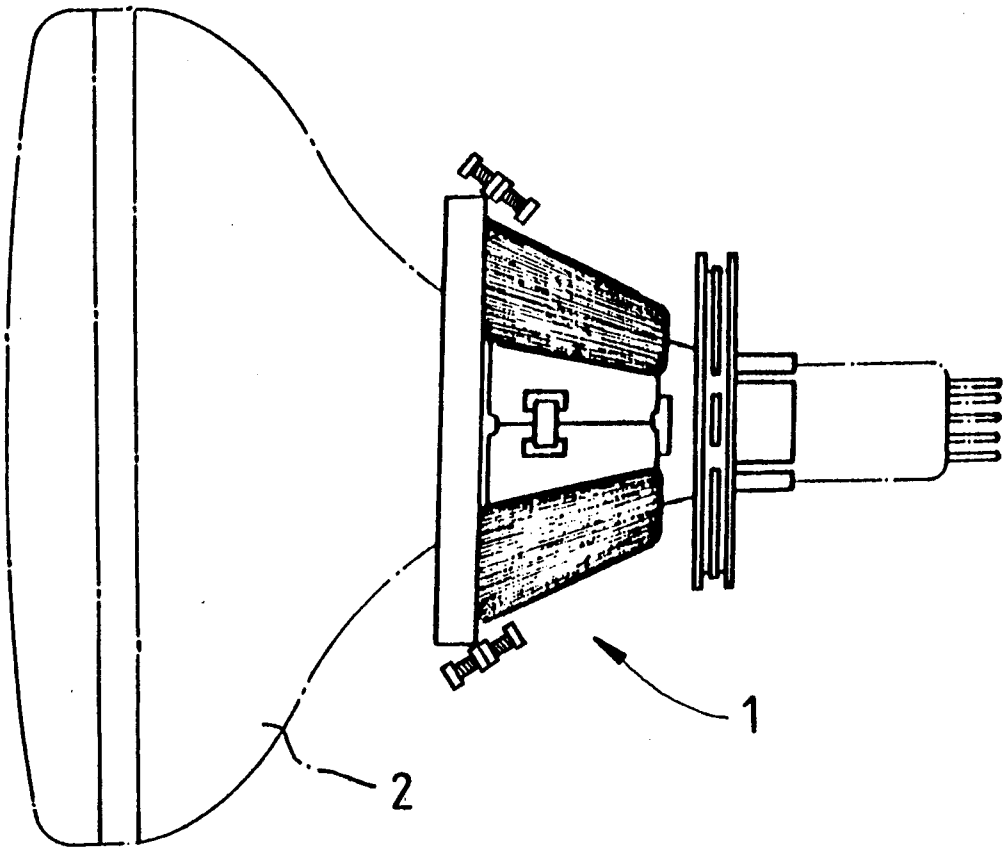
FIG. 3 schematically illustrates the ferrite cores wound with coils and installed on the deflection yoke according to the present invention, the deflection yoke being installed on the neck portion of a cathode ray tube.
Figure 5A:
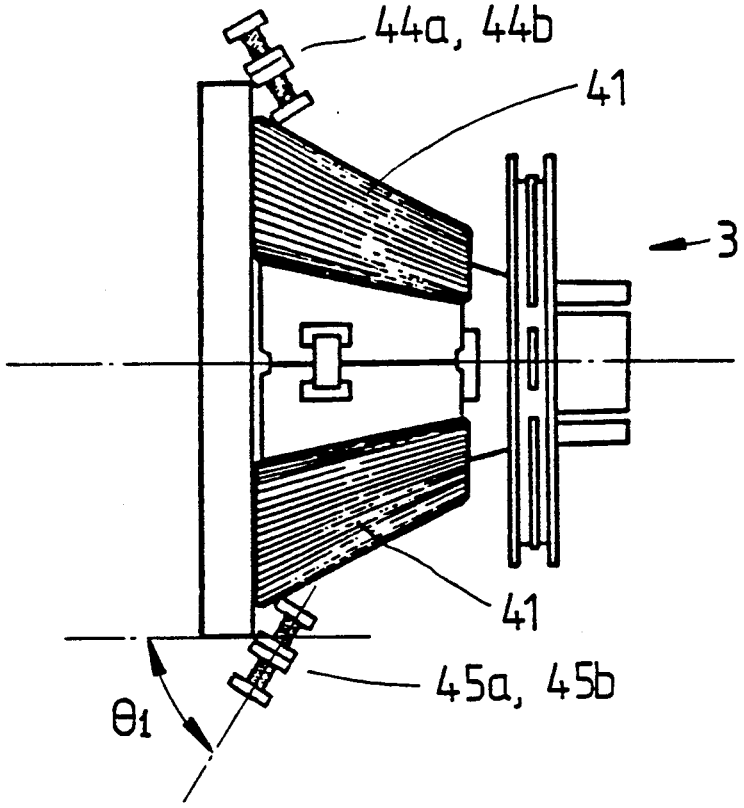
FIGS. 5*a* and 5*b* illustrate the angles of the positions of the ferrite cores relative to the yoke according to the present invention.
Figure 5B:
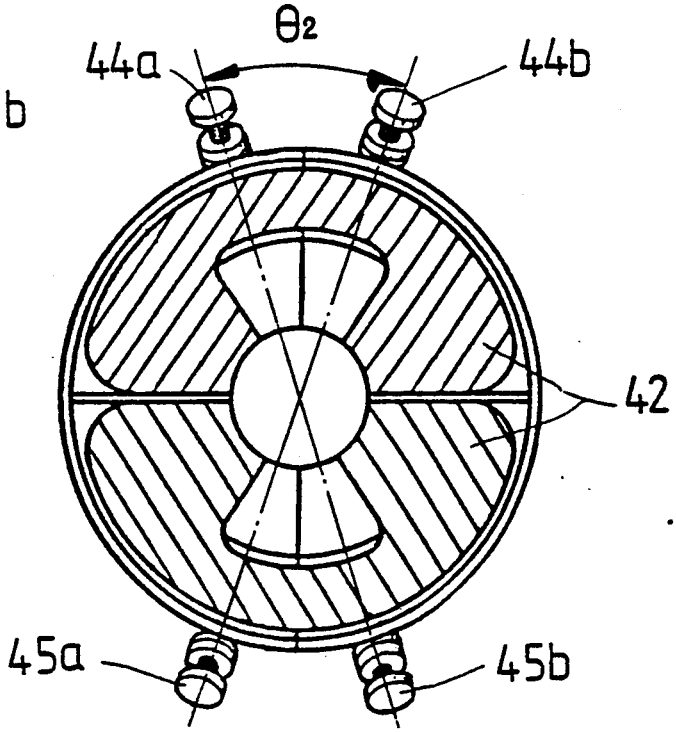

FIG. 3 illustrates a deflection yoke 1 installed on the neck portion of a cathode ray tube. Reference code 2 indicates a cathode ray tube. FIG. 5*a* is a plan view of the deflection yoke of FIG. 3, and FIG. 5*b* is a left side view of the deflection yoke of FIG. 3.

A separator 3 consisting of a combination of a pair of funnel shaped resin pieces is surrounded by a vertical deflection coil 41, and, inside the separator 3, there is installed a horizontal deflection coil 42. On the upper and lower positions of the edge of the flange of the separator, there are disposed ferrite cores 44*a*, 44*b*, 45*a*, 45*b*, on each of which a pair of coils are installed. The coils wound on the ferrite cores are connected to the horizontal deflection coils 42.

Figure 4A:
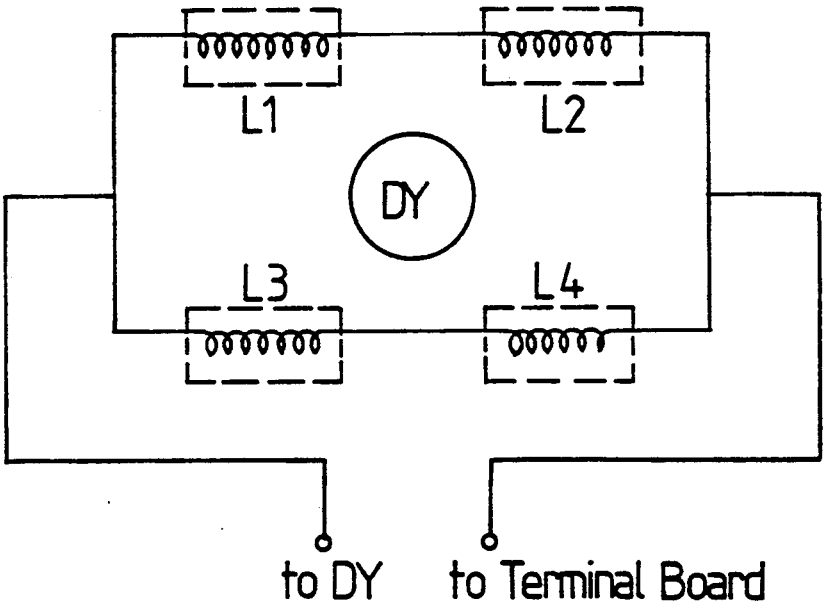
Figure 4B:
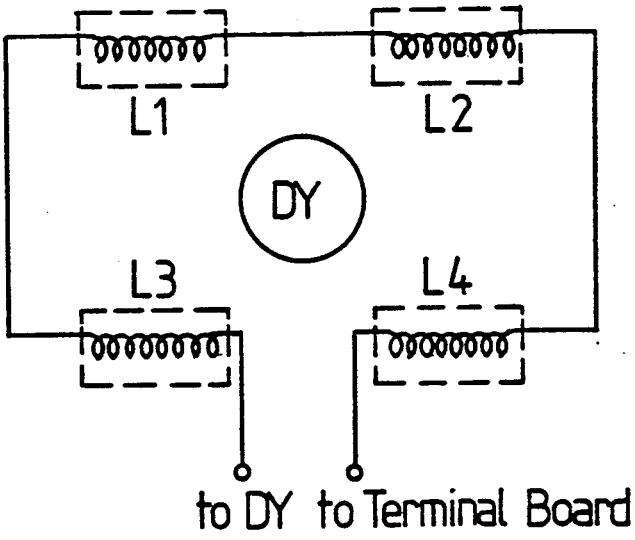
Figure 4C:
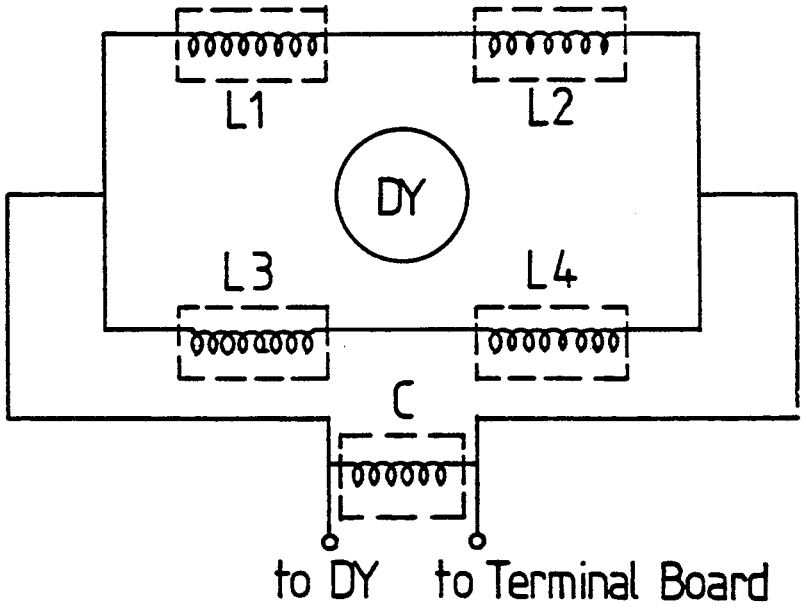
Figure 4D:
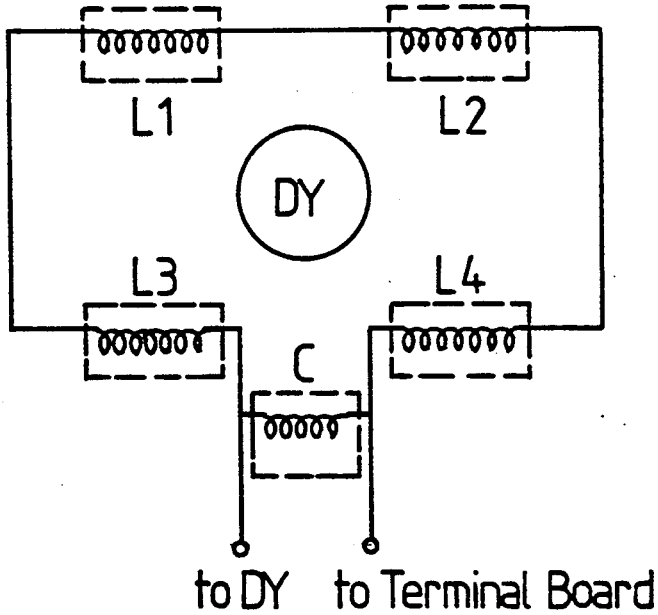

Further, the coils wound on the ferrite cores are wound in such a manner that, if the coils of the ferrite cores 44*a*, 44*b* are wound in the clockwise direction, the coils of the ferrite cores 45*a*, 45*b* should be wound in the anticlockwise direction, if an advantage is to be gained. As shown by the circuital illustrations of FIGS. 4*a* to 4*d*, two upper offsetting coils L1, L2 and two lower offsetting coils L3, L4 which are disposed around the deflection yoke DY in a state wound on the ferrite cores are respectively interconnected in series. Further, the two sets of the offsetting coils L1, L2 and L3, L4 can be interconnected in parallel as shown in FIG. 4*a*, or they may be interconnected in series as shown in FIG. 4*b*. Further, one end of these coils is connected to the coil of the deflection yoke DY, while the other end of the coils is connected to a terminal board (not shown).

In the present invention, a current adjusting section C is provided and connected to the coils L1–L4 in parallel. This current adjusting section can be constituted in many different forms, and if it is provided in the form of resistances, it is liable to damages due to the high current level of the deflection yoke(over 10 Ampheres usually). Therefore, it should be desirably formed with coils. By providing such a current adjusting section C, the current value of the coils L1–L4 can be easily adjusted by adjusting only the inductance of the current adjusting section C without adjusting the number of turns of the coils L1–L4.

The ferrite cores are formed in the shape of a drum or a rectangular pole.

Referring to FIG. 5*a*, the angle $\theta 1$ between the axes of the cores 44*a*, 44*b*, 45*a*, 45*b* and the axis of the deflection yoke DY should have a proper magnitude. That is, the angle $\theta 1$ should come within the range of about 58°–63°, so that the electron beams deflected by the horizontal magnetic field should not be influenced.

As shown in FIG. 5*b*, the angular separation of the ferrite cores 44*a*, 44*b* and 45*a*, 45*b* along the circumference of the separator 3 should have a proper angle $\theta 2$. Experiments showed it that it is most effective for offsetting the leaking magnetic fields to separate the cores at an angle $\theta 2$ of 25°–45°.

The present invention constituted as described above is found to give the following effects through repeated experiments.

Figure 6A:
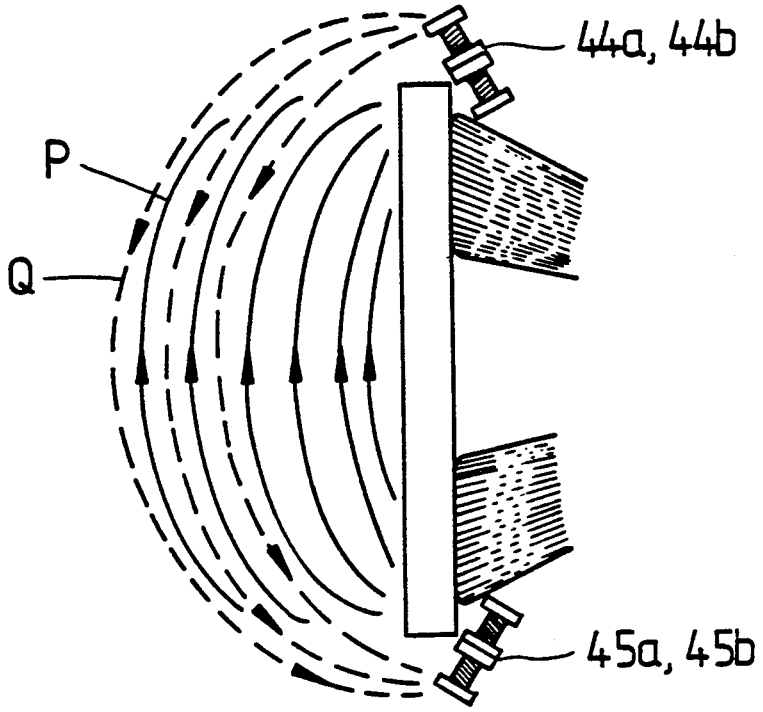
FIGS. 6*a* and 6*b* illustrate the state of neutralizing the impeding magnetic field according to the present invention.
Figure 6B:
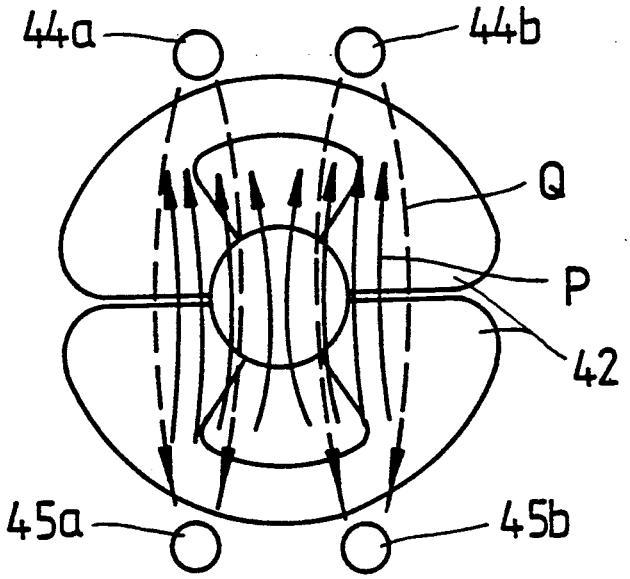

FIGS. 6*a* and 6*b* are for showing the damping effect of the device of the present invention on the leaking magnetic fields. If the cathode ray tube is operated, a leaking component P of the horizontal deflection magnetic field is established by the horizontal deflection coil 42 in the direction of the solid arrow mark. At the same time, currents flow through the coils of the ferrite cores to establish a magnetic field Q in the direction of the dotted arrow mark for offsetting the leaking component P. Of course, the direction of the magnetic field Q can be differently formed depending on the winding directions of the coils of the ferrite cores 44*a*, 44*b*, 45*a*, 45*b*. As shown in FIGS. 6*a* and 6*b*, the magnetic field Q is established in a direction opposite to that of the leaking component P of the horizontal deflection magnetic field, and therefore, the magnetic field Q offsets the leaking component P.

The reason why the angle $\theta 1$ (the angle of the posture of the ferrite cores relative to the axis of the separator) is set to 58°–63° is that this angle is just sufficient for offsetting the stray magnetic fields other than the main magnetic field of the deflection yoke.

Meanwhile, the reason why the separating angle $\theta 2$ between the ferrite cores is set to 25°–45° is that the coils of the cores disposed at such angular intervals are capable of offsetting even the left and right leaking magnetic fields.

Now different embodiments of the method of installing the ferrite cores on the deflection yoke will be described.

Figure 7:
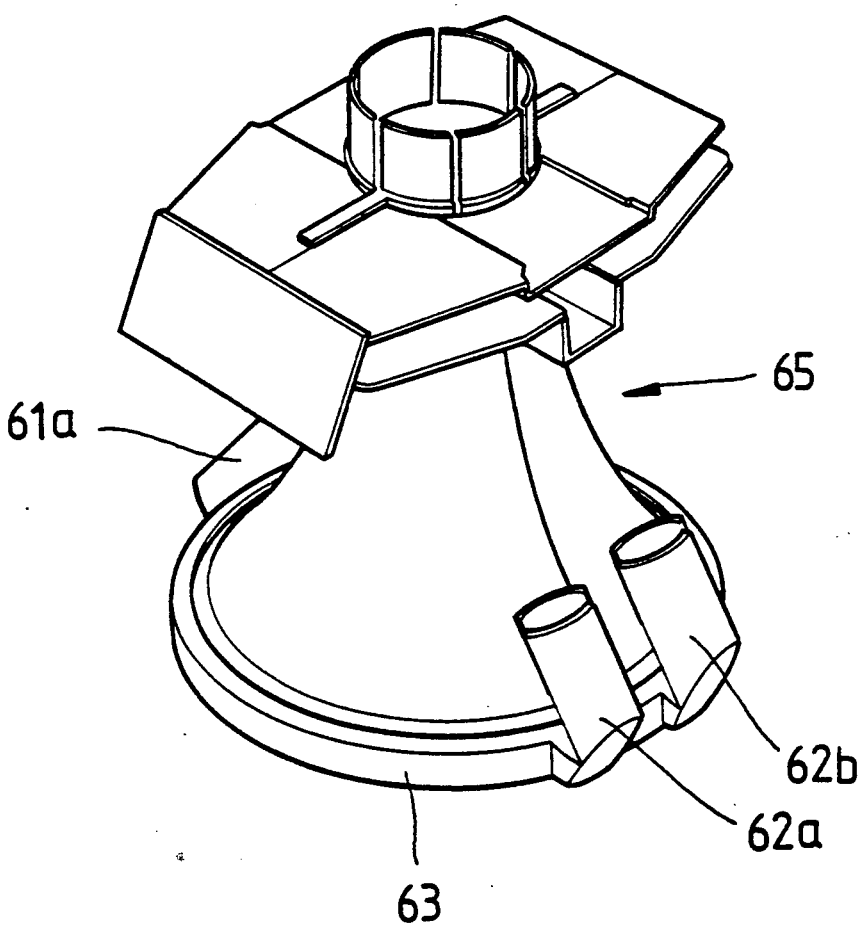
FIG. 7 illustrates an accommodating housing for the ferrite cores installed on the deflection yoke according to the first embodiment of the present invention.
Figure 8:
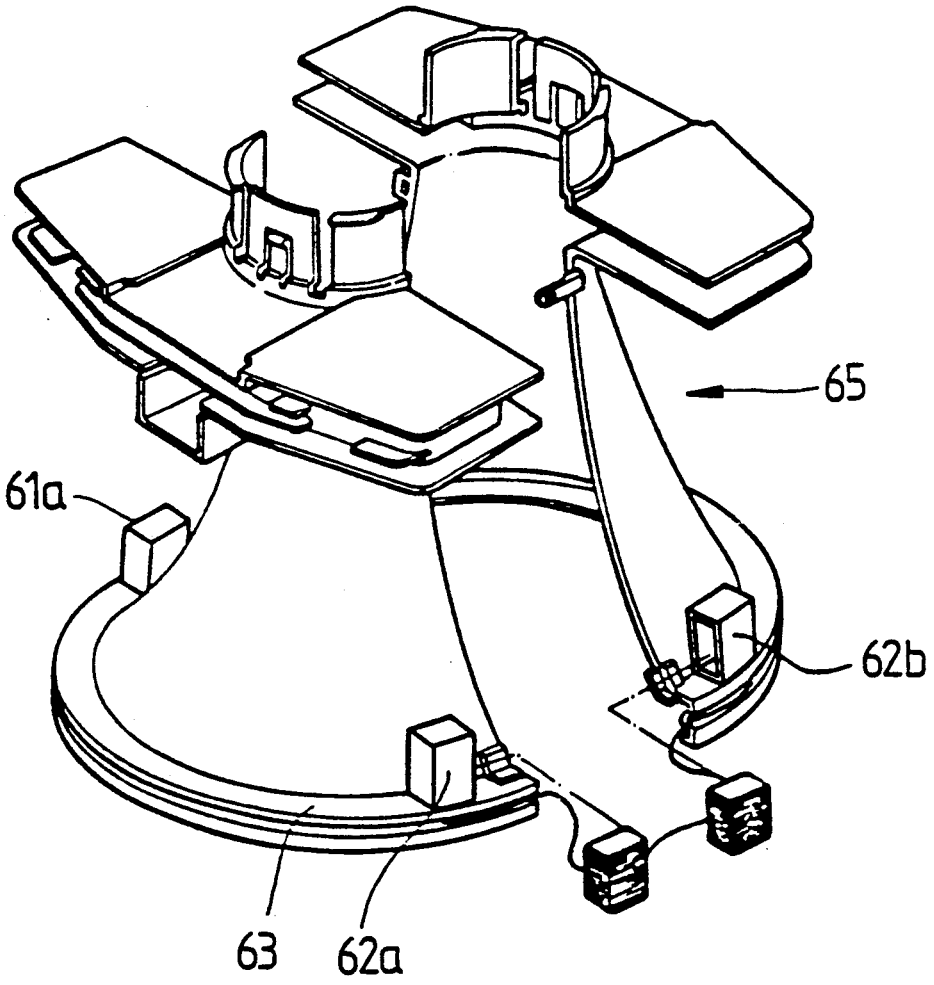
FIG. 8 illustrates a modified structure of the accommodating housing of the first embodiment of the present invention.

FIGS. 7 and 8 illustrate the first embodiment of the present invention, and as shown in these drawings, cylindrical or rectangular pole shaped housings 61*a*, 61*b*, 62*a*, 62*b* for accommodating the ferrite cores and the coils are integrally formed on the outer edges of the flange 63 of the beam outgoing side of the separator 65 at the installation angles $\theta 1$ and $\theta 2$. This structure enables to install the coil-wound cores at the proper positions of the deflection yoke in an easy manner.

Figure 9:
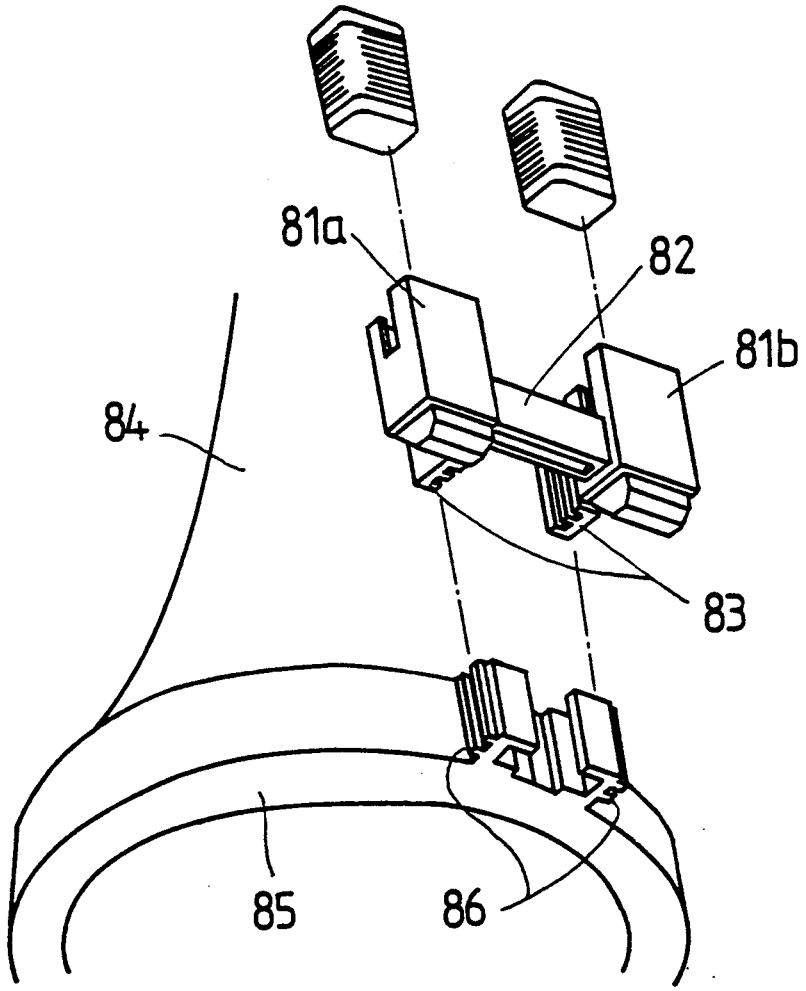
FIG. 9 illustrates a detachably installed ferrite core accommodating housing according to the second embodiment of the present invention.

FIG. 9 illustrates the second embodiment of the present invention, and as shown in this drawing, core housings 81*a*, 81*b* are mutually integrally secured by means of a rib 82 on which sliding grooves 83 are formed. The outer circumferential edge of the flange 85 of the beam outgoing side of the separator 84 is provided with sliding projections 86 for being matched with the sliding grooves 83. According to this embodiment, the core housings 81*a*, 81*b* are detachably attached to the outer edge of the flange through the matches between the sliding grooves 83 and the sliding projections 86. Of course, the installation angles of the cores should come within the above mentioned ranges.

Figure 10:
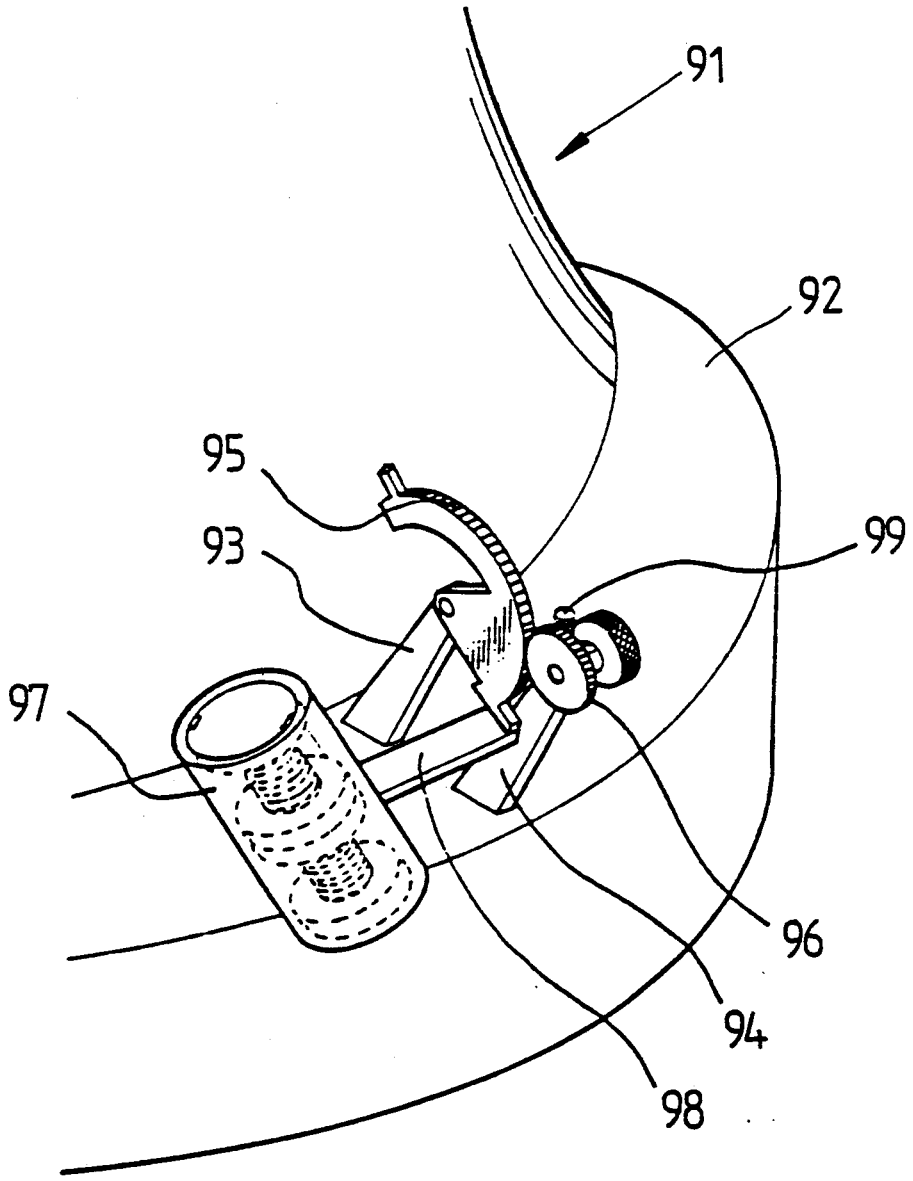
FIG. 10 illustrates an angular posture-adjustable ferrite core accommodating housing according to the third embodiment of the present invention.

FIG. 10 illustrates the third embodiment of the present invention, and as shown in this drawing, the angle between the axes of the ferrite cores and the axis of the deflection yoke is adjustable. Supporting arms 93, 94 are formed on the flange of the beam outgoing side of the separator 91, and a sector gear 95 and an adjusting gear 96 are provided in a mutually meshed form and a rotatable form at the leading ends of the supporting arms 93, 94. A core housing 97 is fixed through a connecting member 98 to the sector gear 95, and therefore, if the adjusting gear 96 is rotated, the sector gear 95 which is meshed with the adjusting gear 96 is rotated, with the result that the core housing 97 fixed to the sector gear 95 is rotated. Once the angle of the axis of the core housing 97 relative to the axis of the deflection yoke is adjusted, the adjusting gear 96 is fixed by a stopper 99 which is threadably coupled with the arm 94. through the adoption of such a method, the installation angles of the ferrite cores can be properly adjusted in such a manner that the leaking magnetic fields should be properly offset.

Figure 11A:
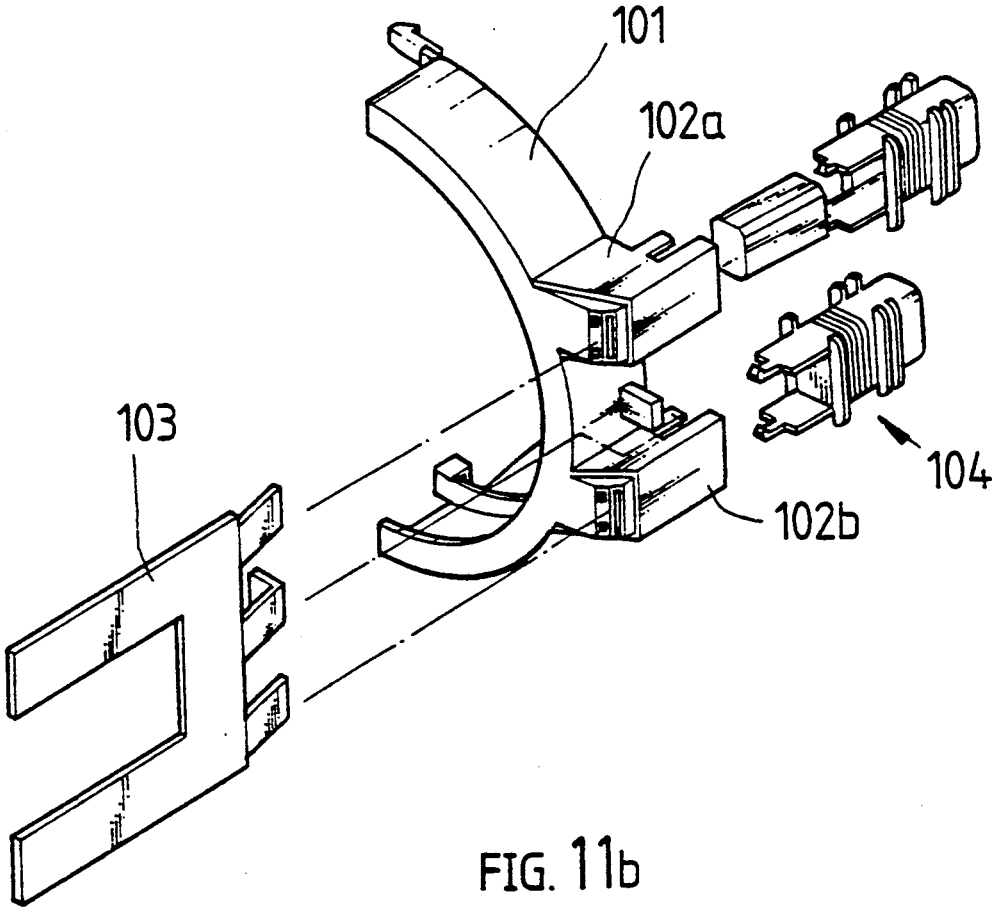
FIG. 11*a* is a schematical exploded perspective view showing auxiliary steel pieces installed at the leading ends of the ferrite cores according to the fourth embodiment of the present invention.
Figure 11B:
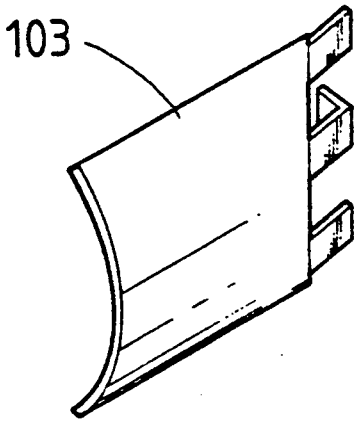
FIG. 11*b* illustrates another modified shape of the auxiliary steel piece.
Figure 11C:
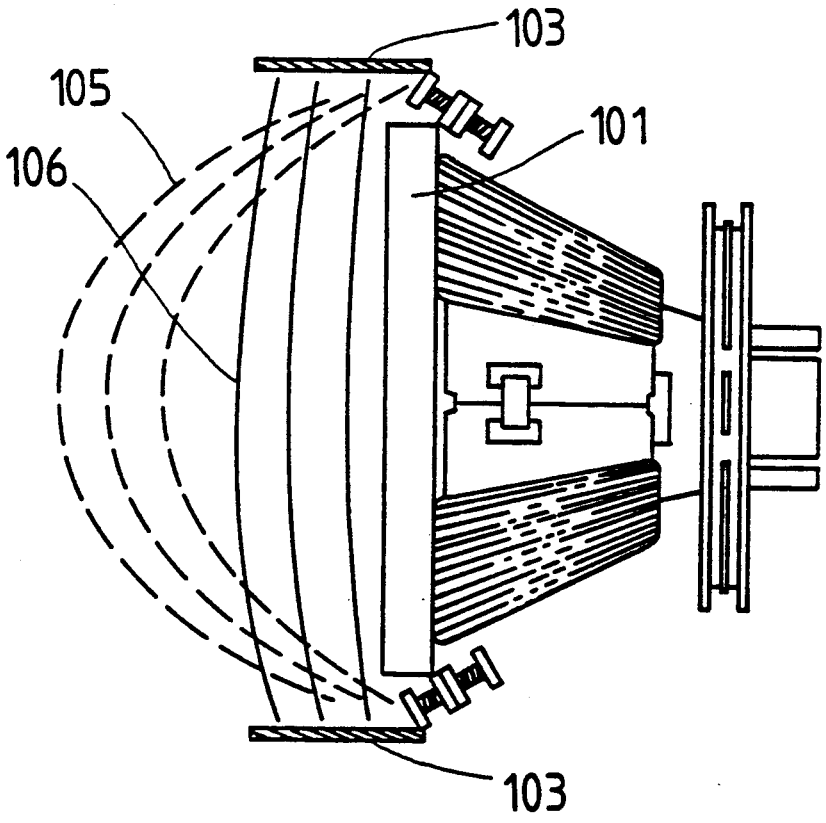
FIG. 11*c* illustrates the influence given by the auxiliary steel pieces to the formation of the magnetic fields.

FIGS. 11*a* to 11*c* illustrate the fourth embodiment of the present invention, and as shown in these drawings, a steel piece 103 made of permalloy together with core housings 102*a*, 102*b* are installed on the flange 101 of the beam outgoing side of the deflection yoke. This steel piece performs the role of helping to establish the offsetting magnetic field established by the core 104 with the coil wound. The effect of this embodiment will be described below.

There is a limit in increasing the number of the turns of the coils of the ferrite cores in order to offset the leaking magnetic fields. That is, if the number of the turns is increased over a certain value, although it is advantageous for offsetting the leaking magnetic fields, the deflecting forces of the deflection yoke are dropped, with the adverse result that the size of the picture is reduced.

However, if the above described steel piece made of permalloy is installed, it is experimentarily shown that the leaking magnetic fields are effectively offset even without increasing the number of the turns of the coils. In FIG. 11C, the dotted lines 105 show the residue impeding magnetic field for the case where only the cores with coils wound are installed without the steel piece 103, while the solid lines 106 represent the residue impeding magnetic field for the case where both the steel piece 103 and the coils of the cores are installed together.

What is claimed is:

1. A deflection yoke having a central axis and being installed on a neck portion of a cathode ray tube for deflecting electron beams shot outward by an electron gun, comprising:

two pairs of ferrite cores disposed on a flange portion of the outward side of the deflection yoke in opposing relation about the central axis;

two pairs of coils, wherein each of said coils is wound on a respective one of said ferrite cores; and means for housing the ferrite cores, which means for housing is located on the flange portion of the deflection yoke, wherein the ferrite cores in each of the two pairs are positioned along the flange at an angle $\theta_2$ of 25–45 degrees about the central axis, for halving the flare of horizontal deflection coils of the deflection yoke.

2. The deflection yoke as claimed in claim 1, wherein the means for housing comprises two pairs of housings, the housings in each pair being connected in parallel by a rib, and a sliding groove is formed in one side of each housing and a sliding projection is formed at a predetermined place on the deflection yoke flange portion corresponding to the sliding groove so that each housing is detachably attached to the flange portion.

3. The deflection yoke as claimed in claim 1, further comprising a sector gear, wherein the means for housing comprises two pairs of housings each connected to the sector gear which is hinged to a supporting arm mounted on the flange portion and inclination angles of the housings relative to the central axis of the deflection yoke are adjustable by adjusting a gear which is meshed to the sector gear.

4. The deflection yoke as claimed in any one of claims 1 to 3, further comprising auxiliary steel pieces for attachment to a predetermined place on the housing, the leading end of the steel pieces extending to the outward side of the deflection yoke.

5. The deflection yoke as claimed in any one of claims 1 to 3, wherein the ferrite cores are housed in ferrite core accommodating housings which are installed on the flange portion of the outward side of the deflection yoke.

6. The deflection yoke as claimed in claim 5, wherein the ferrite core accommodating housings which are detachably attached on the flange portion of the outward side of the deflection yoke.

7. The deflection yoke as claimed in any one of claims 1 to 2, further comprising means for adjusting angular positions of the ferrite cores relative to the axis of the deflection yoke.

8. The deflection yoke as claimed in claim 7, wherein the means for adjusting comprises a sector gear.

9. The deflection yoke as claimed claim 5, further comprising means for adjusting angular positions of the ferrite core accommodating housings relative to the axis of the deflection yoke.

10. The deflection yoke as claimed in claim 9, wherein the means for adjusting comprises a sector gear.

11. The deflection yoke as claimed in any one of claims 1 to 3, wherein steel pieces are attached on open leading ends of the ferrite cores.

12. The deflection yoke as claimed in claim 5, wherein steel pieces are attached on open leading ends of the ferrite cores.

13. The deflection yoke as claimed in claim 6, wherein steel pieces are attached on open leading ends of the ferrite cores.

14. The deflection yoke as claimed in claim 7, wherein steel pieces are attached on open leading ends of the ferrite cores.

15. The deflection yoke as claimed in claim 9, wherein steel pieces are attached on open leading ends of the ferrite cores.

16. The deflection yoke as claimed in claim 1, wherein the coils on each pair of ferrite cores are connected in series, and the connections between the pairs of the coils are one of serial and parallel.

17. The deflection yoke as claimed in claim 16, wherein a current adjusting section is connected in parallel between an input terminal and an output terminal of the coils.

18. The deflection yoke as claimed in claim 17, wherein the current adjusting section comprises a current adjusting coil.

* * * * *

UNITED STATES PATENT AND TRADEMARK OFFICE

CERTIFICATE OF CORRECTION

PATENT NO. : 5,124,613

DATED : June 23, 1992

INVENTOR(S) : Wonseok Park, et. al.

It is certified that error appears in the above-identified patent and that said Letters Patent is hereby corrected as shown below:

Column 1, line 64, change "Refer" to -- refer --.

Column 3, line 15, after "cores" insert -- are --.

Column 4, line 60, change "yoke(over" to -- yoke (over --.
Column 4, line 60, change "Ampheres" to -- amperes --.

Column 6, line 17, change "through" to -- Through --.

Column 8, line 1, after "calimed" insert -- in --.

Signed and Sealed this

Twenty-eighth Day of September, 1993

Bruce Lehman

*Attest:*

BRUCE LEHMAN

*Attesting Officer*

*Commissioner of Patents and Trademarks*